United States Patent [19]

Morgan

[11] Patent Number: 4,498,298

[45] Date of Patent: Feb. 12, 1985

[54] STIRLING CYCLE PISTON ENGINE

[76] Inventor: George R. Morgan, 1831 S. Berthed Pl., Tucson, Ariz. 85710

[21] Appl. No.: 532,652

[22] Filed: Sep. 15, 1983

[51] Int. Cl.[3] ..... F02G 1/04

[52] U.S. Cl. ..... 60/525; 60/517

[58] Field of Search ..... 60/520, 525, 517

[56] References Cited

U.S. PATENT DOCUMENTS

| | | | |
|---|---|---|---|
| 2,564,363 | 8/1951 | Horowitz et al. | 60/525 |
| 3,319,416 | 5/1967 | Renshaw | 60/525 |
| 3,552,120 | 1/1971 | Beale | 60/525 |

FOREIGN PATENT DOCUMENTS

| | | | |
|---|---|---|---|
| 523269 | 4/1954 | Belgium | 60/525 |

*Primary Examiner*—Allen M. Ostrager

[57] ABSTRACT

This device is an improvement over the conventional type of Stirling cycle engine where the expander piston is connected to a crankshaft and the displacer piston is connected to the same or another crankshaft for operation. The improvement is based on both the expansion and displacer pistons being an integral unit having regenerating means which eliminate the mechanisms that synchronize the regeneration mode.

1 Claim, 6 Drawing Figures

STIRLING CYCLE PISTON ENGINE

The object of this invention is to provide a reliable, efficient and viable Stirling cycle piston engine that is an improvement over the usual type of hot gas engine where the expander piston is connected to a crankshaft and the displacer piston is connected to the same or another crankshaft for power output.

This invention is based on the design concept of both the expander/displacer pistons being an integral unit having regenerating means. To demonstrate the versatility of said design two types of Stirling cycle piston engines will be presented: a free piston (see FIG. 1) and a two cylinder horizontal opposed piston with crankshaft (see FIG. 6).

In the case of the free piston engine an armature is attached between two pair of expander/displacer pistons and oscillates in a linear electrical generator creating electricity. All mechanical linkages and attachments to the double-ended piston are eliminated increasing simplicity and reliability. Said design with an expander cylinder attached to the displacer cylinder and bolted to the housing of said linear generator, to which all other components are attached, constitutes a rugged and easily maintained prime mover.

Said linear electrical generator and engine can be designed for their maximum efficiency by setting a specific speed and load. Both said expander and displacer pistons, being an integral part, eliminate mechanisms that syncronize or time the regeneration mode. The ratio of the diameters of said expander/displacer pistons can be varied for maximum regeneration.

The inertia force created by the movement of said double-ended piston without mechanical restraints could possibly extend said double-ended piston beyond its maximum displacement and cause damage. To alleviate this condition said double-ended piston is arrested by the compression of the working gas in the regenerator-cooler, by the rebound area in the displacer cylinder, by compression of the residual working gas in the expander cylinder, or possibly electronically by said linear generator.

A two cylinder horizontal opposed piston engine (see FIG. 6) utilizes the same expander/displacer pistons and cylinders, but said displacer cylinders are attached to a crankcase eliminating said linear generator. Said engine can be coupled to a rotary electrical generator or directly coupled to a mechanical load. Different cylinder configurations can be fabricated to meet a specific design criteria.

On both engines the external heater tubes are located on the ends of the expander cylinders leaving ample room for the mounting of a variety of burners (not shown) or combustion systems.

A multiple number of regenerator-cooler units can be utilized (only one per cylinder shown) and can be made short and direct or longer depending on the efficiency desired.

Ports in the displacer cylinders are used for adding-/subtracting gas into the system to vary the speed or load of the engines.

Said engines' basic designs lend themselves to very high temperatures, and, therefore, high efficiency. This is accomplished by incorporating thick expander cylinder walls and rugged pistons. Said engines can be fabricated from any number of materials depending on the cost and performance desired. Lubrication can be varied from a liquid to a solid or the like.

DETAILED DESCRIPTION

The free piston engine consists of four major components: the linear electrical generator, cylinders, piston assembly and regenetor-coolers. The external burner units are considered peripheral and are not included (see FIG. 1).

Figure 1:
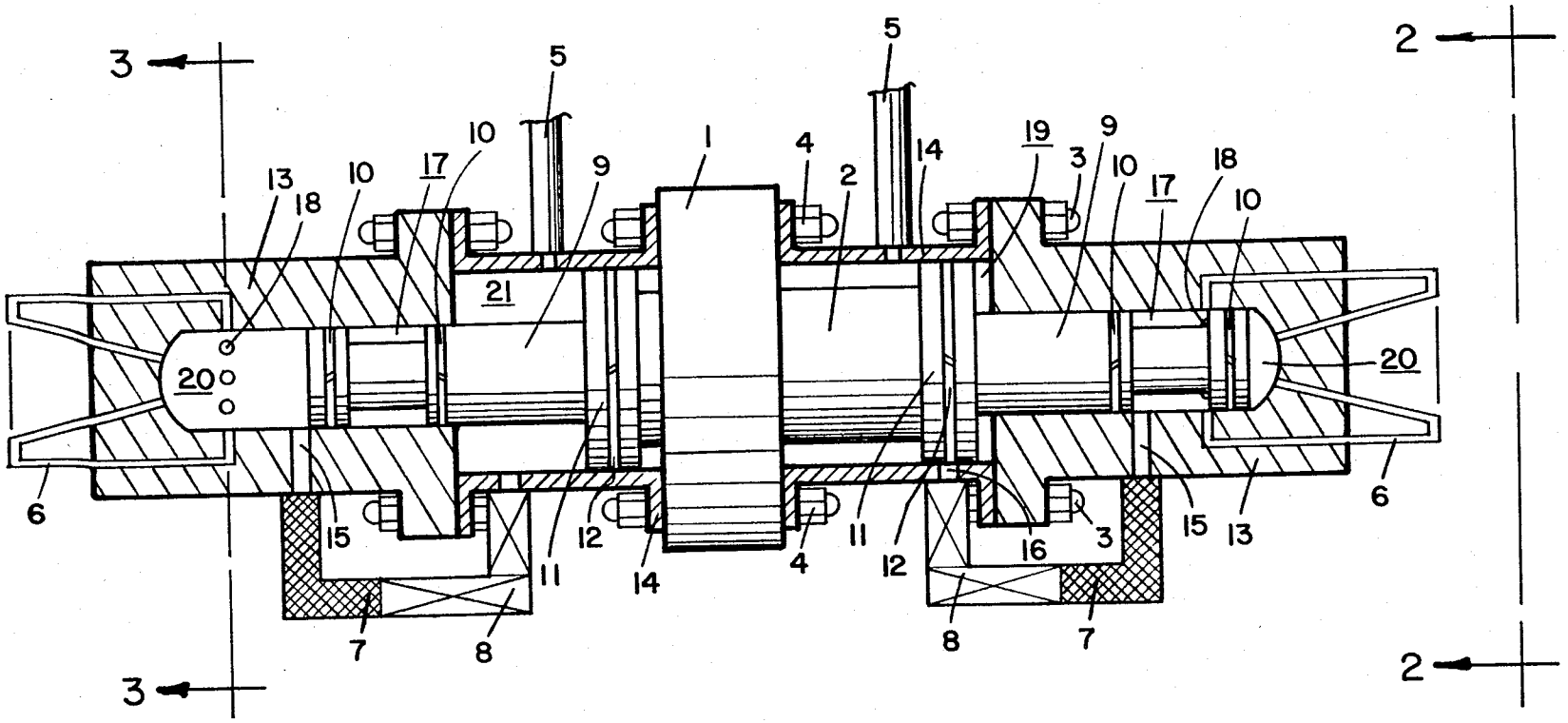
FIG. 1 is a longitudinal sectional view of the engine showing the working mechanism, porting and linear generator.
Figure 2:
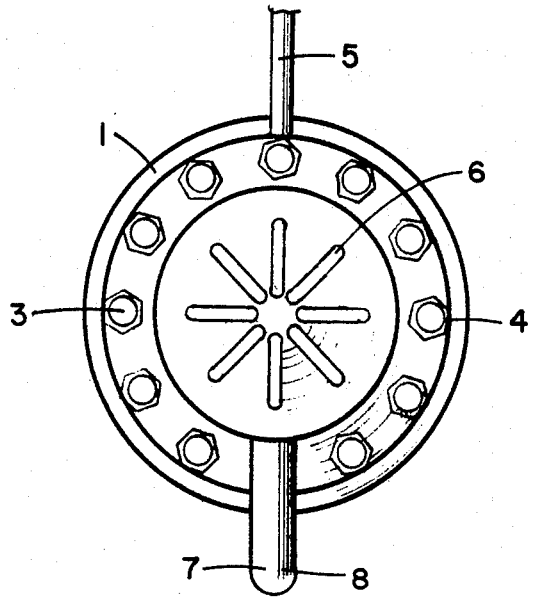
FIG. 2 is an end view showing the heater tubes and cylinder attachments.

The armature 2 of said linear electrical generator 1 is attached to the base of both displacer pistons 11, making a long double-ended piston (see FIG. 1).

The two cylinder opposed crankshaft engine consists of six major components: the crankcase, crankshaft, connecting rods, cylinders, pistons and regenerator-coolers. Said crankcase 25 houses said crankshaft 22 with said connecting rods 26, wrist pins 24 and displacer piston bracket 23 (see FIG. 6).

Figure 4:
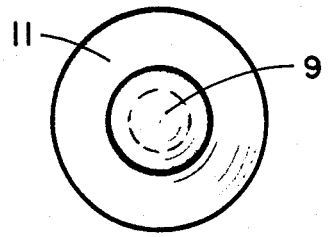
FIG. 4 is a longitudinal view of the expander and displacer pistons, showing the piston seals.
Figure 5:
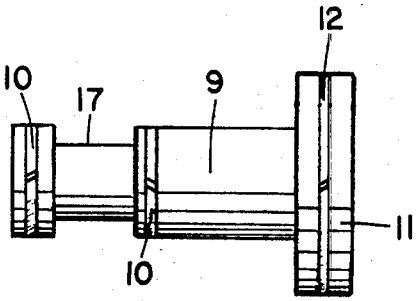
FIG. 5 is a plan view of the expander and displacer pistons.

Each piston unit incorporates both the expander piston 9 with seals 10 and the displacer piston 11 with seals 12, making it an integral unit (see FIGS. 4 and 5). Said expander piston 9 incorporates the regenerator area passage 17 that communicates to the regenerator 7 and cooler 8. The expander cylinder 13 is attached by bolts 3 and 4 to the displacer cylinder 14. Said displacer cylinder 14 is bolted 3 and 4 to said linear generator 1 or crankcase 25 making a long cylindrical unit.

Figure 6:
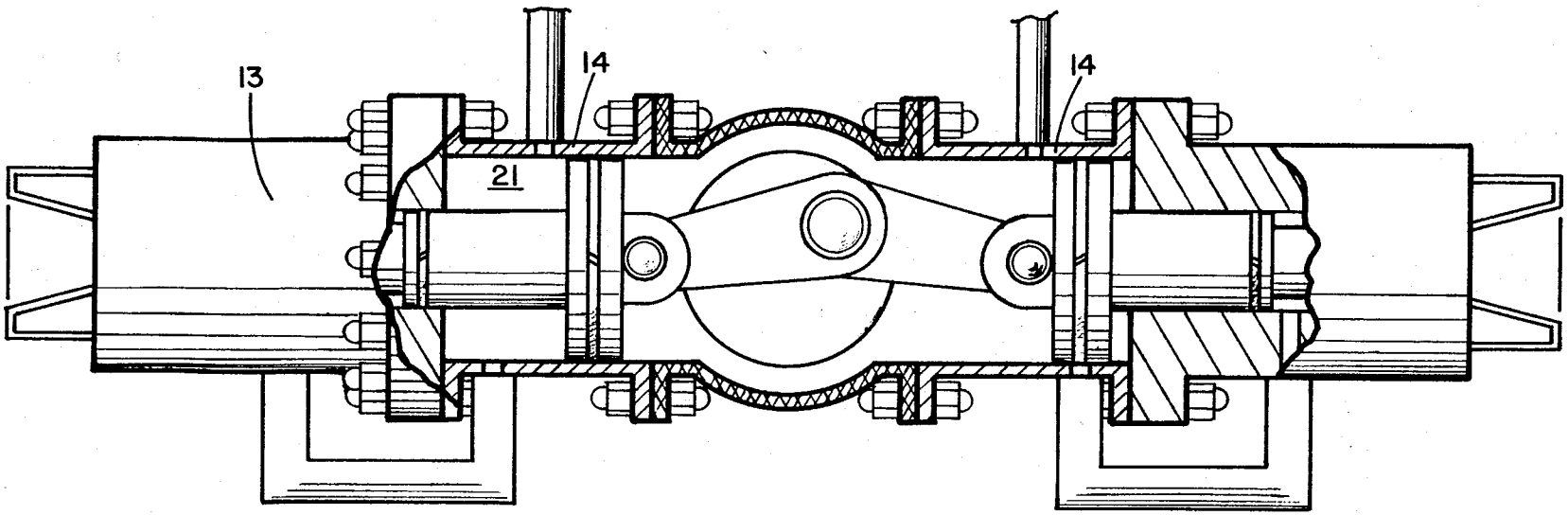
FIG. 6 is a longitudinal view of a two cylinder horizontal opposed Stirling cycle piston engine, showing crankshaft and related mechanisms.

The external heater tubes 6 are shown diagramatically in FIG. 1 and FIG. 6 and are located on the ends of said expander cylinder 13.

Said displacer cylinder 14 communicates via an inject/reject gas tube 5 to an external gas source (not shown).

Figure 3:
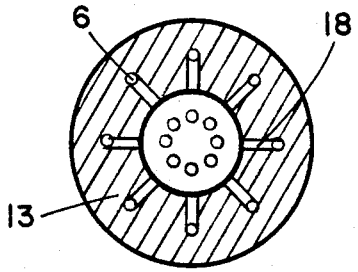
FIG. 3 is an end sectional view of the expander cylinder head and regenerator tube ports.

Said expander cylinder 13 incorporates tube ports 18 (see FIG. 1 and FIG. 3), which communicates from said expander cylinder 13 to the heating area via the heater tubes 6 and into the expander working space 20.

Said regenerator port 15 is located in the expander cylinder 13 and communicates with said regenerator 7, cooler 8 and displacer working space 21. Said regenerator 7 and cooler 8 are attached to both the expander cylinder 13 and the displacer cylinder 14 and communicate to the regenerator port 15 and cooler port 16.

In the operation of both said Stirling cycle engines (see FIG. 1 and FIG. 6) the working gas is heated in said working space 20. Said heated working gas builds up pressure and moves said expander piston 9 to its maximum displacement uncovering said regenerator port 15. Said working gas is then exhausted through regenerator port 15 into regenerator 7 and cooler 8 and into said displacer working space 21. Said displacer piston 11 being an integral part of said expander piston 9 is also at its maximum displacement. At this regeneration mode of the cycle the working gas has been cooled and reduced in pressure and gas can be injected/-rejected from said displacer working space 21 to regulate the load or speed of said engine.

As said displacer piston 11 moves from its maximum extention, said cooled working gas is compressed in said cooler 8 and regenerator 7, and when said regenerator port 15 communicates with said expander piston regenerator passage 17, said compressed working gas passes through said regenerator 7 absorbing the retained heat and passes into said expander piston regenerator area passage 17, which communicates with said regenerator tube ports 18 and into said heater tubes 6 absorbing heat and expanding in said hot working space 20.

Being a doubled-ended piston or crankshaft operated piston oscillating in a cylinder, the same cycle of events is repeated in the other cylinder except 180° out of phase.

What is claimed is:

1. A hot gas Stirling cycle engine in which a plurality of gases are alternately expanded and compressed in closed thermodynamic systems comprising:

a first cylinder with a first piston with a working gas passage reciprocating in said cylinder;

a second cylinder located on cylindrical axis mounted to said first cylinder with a second piston reciprocating in said cylinder in a fixed relationship with said first piston;

a transmission of power means coupled to said second cylinder mounted perpendicular to cylinderical axis operatively coupled to said second piston;

a third cylinder located on cylindrical axis mounted to said transmission of power means, with a third piston reciprocating in said cylinder in a fixed phase relationship to said first and second pistons;

a fourth cylinder located on cylinderical axis mounted to said third cylinder with a fourth piston, with a working gas passage reciprocating in said cylinder in a fixed relationship to said third piston;

a first working space defined by said first cylinder and said first piston in which a heated gas expands to perform work in moving said first piston;

a second working space defined by said second cylinder and said second piston in which a cooled gas is compressed;

a third working space defined by said third cylinder and said third piston in which a cooled gas is compressed;

a fourth working space defined by said fourth cylinder and said fourth piston in which a heated gas expands to perform work in moving said fourth piston;

a first heating means external of said first cylinder providing a heat source for gas flowing into said first working space;

a second heating means external of said fourth cylinder providing a heat source for gas flowing into said fourth working space;

a first regenerator-cooler unit located near said cylinderical axis located in a gas passage connecting said first and second working spaces;

a second regenerator-cooler unit located near said cylinderical axis and located in a gas passage connecting said third and fourth said working spaces;

a first working gas inject/reject regulation means external of said second cylinder providing a source of working gas to second working space; a second working gas inject/reject regulation means external of said third cylinder providing a source of working gas to third working space;

whereby a first working gas flows from said first regenerator-cooler unit through said first piston working gas passage into said first heating means as said first piston is at T.D.C., allowing said first working gas to be heated by said first heating means and to flow into said first working space, moving said first piston from T.D.C., blocking said first working gas flow from said first regenerator-cooler unit, through said first piston working gas passage, allowing expansion of said first working gas to move said first piston to B.D.C., performing work and to flow through said first regenerator-cooler unit into said second working space where it is compressed, then flows through said first regenerator-cooler unit, through said first piston working gas passage as said first piston moves to T.D.C., allowing said first working gas to flow into said first heating means to cyclically perform a first Stirling cycle;

wherein a second working gas flows from said second regenerator-cooler unit through said fourth piston working gas passage into said second heating means as said fourth piston is at T.D.C., allowing said second working gas to be heated by said second heating means and to flow into said fourth working space moving said fourth piston from T.D.C., blocking said second working gas flow from said second regenerator-cooler unit through said fourth piston working gas passage, allowing expansion of said second working gas to move said fourth piston to B.D.C., performing work and to flow through said second regenerator-cooler unit into said third working space where it is compressed, then flows through said second regenerator-cooler unit, through said fourth piston working gas passage, as said fourth piston moves to T.D.C., allowing said second working gas to flow into said second heating means to cyclically perform a second Stirling cycle.

wherein said first and second cycles are 180° out of phase with one another.

* * * * *